United States Patent [19]

Sandoval

[11] 4,451,925

[45] May 29, 1984

[54] CHARGING SYSTEM FOR ELECTRIC ARC FURNACES

[75] Inventor: E. Jorge Sandoval, Guadalupe, Mexico

[73] Assignee: Hylsa, S.A., Monterrey, Mexico

[21] Appl. No.: 417,213

[22] Filed: Sep. 13, 1982

[51] Int. Cl.[3] ..... F27D 3/10

[52] U.S. Cl. ..... 373/81; 414/162

[58] Field of Search ..... 414/162, 167, 180, 183, 414/185, 190, 163, 164; 266/176; 373/79, 80, 81, 33, 115, 142

[56] References Cited

U.S. PATENT DOCUMENTS

| | | | |
|---|---|---|---|
| 1,807,090 | 5/1931 | Pistor | 373/81 |
| 2,672,491 | 3/1954 | Lamb . | |
| 2,694,097 | 11/1954 | Collin . | |
| 3,163,520 | 12/1964 | Collin et al. . | |
| 3,634,592 | 1/1972 | Pantke et al. . | |
| 3,666,871 | 5/1972 | Thom et al. . | |
| 3,681,049 | 8/1972 | Celada . | |
| 3,737,554 | 6/1973 | Horibe et al. . | |
| 3,760,960 | 9/1973 | Schumacher et al. . | |
| 3,900,696 | 8/1975 | Tress et al. . | |
| 3,936,588 | 2/1976 | Asphaug et al. . | |
| 3,988,525 | 10/1976 | Stenkvist . | |
| 4,002,465 | 1/1977 | Brusa . | |
| 4,160,869 | 7/1979 | Robertson . | |
| 4,225,745 | 9/1980 | Harwell . | |

FOREIGN PATENT DOCUMENTS

| | | | |
|---|---|---|---|
| 1286524 | 1/1969 | Fed. Rep. of Germany | 373/79 |
| 1503497 | of 0000 | United Kingdom . | |
| 1569887 | 6/1980 | United Kingdom . | |

OTHER PUBLICATIONS

McGannon, The Making, Shaping and Treating of Steel, 9th Ed., Pittsburgh, 1971, pp. 548 to 577.

*Primary Examiner*—Roy N. Envall, Jr.
*Attorney, Agent, or Firm*—Curtis, Morris & Safford

[57] ABSTRACT

An arrangement for charging an electric arc furnace with a relatively free-flowing charge of sponge iron or other iron-containing particles distributes the charge of particles within the furnace through a first chute before a melting stage of an electric arc steelmaking operation is begun, and then continuously through a second chute which extends through the roof of the furnace during the melting stage. The first chute extends from a hopper containing the sponge iron and can be moved when the roof is open to feed the charge into the furnace. A distributor cone at the lower end of this chute distributes the sponge iron in a predetermined pattern. A second chute affixed to the furnace roof and in communication therethrough with the interior of the furnace permits continuous charging of the furnace during operation.

18 Claims, 5 Drawing Figures

36
38
64
42
66
40
84
50
70
68
44
74
78
48
76
46
82
72
80
54
62
62
60
60
32
32
58
56
10

FIG. 4
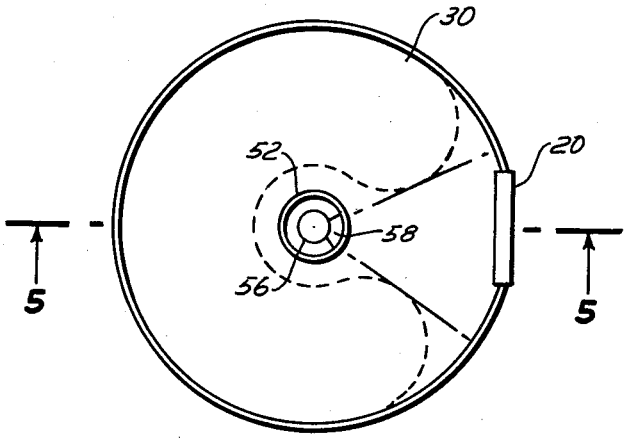
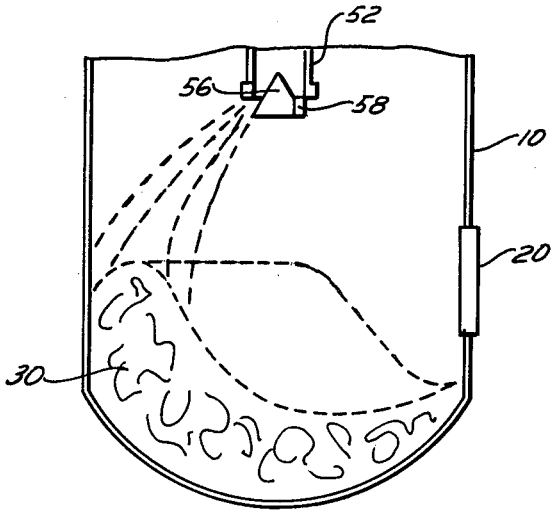
FIG. 5

CHARGING SYSTEM FOR ELECTRIC ARC FURNACES

BACKGROUND OF THE INVENTION

This invention relates to electric-arc steelmaking, and more particularly relates to an improved arrangement for initially charging an electric arc furnace with sponge iron, and subsequently continuously charging the furnace during a melting or a refining operation.

Electric arc furnaces (EAFs) are usually charged batchwise. To do this, the roof assembly, including the electrodes, are moved to the side to open the top of the furnace. Then charging buckets, containing either scrap or prereduced particles, such as sponge iron in the form of pellets, lumps, or briquettes, are carried over the open furnace and dumped into it.

These buckets are generally handled by an overhead crane arrangement which serves a group of EAFs. The EAFs are programmed to operate at staggered intervals, so that the charging period for each EAF occurs at a different time, and there are no dead times waiting for the crane.

Electric-arc steelmaking generally has two successive stages, namely, a melting stage and a refining stage. During the melting stage, solid ferrous materials are melted down, and during the refining stage, the concentrations of the particular elements are adjusted to produce a steel alloy of a predetermined specification.

To start the melting stage, the EAF is conventionally charged with scrap and/or sponge iron. When the initial charge has melted down, the roof of the EAF is swung aside to open the EAF again, and another bucket containing a supplemental charge of scrap and/or sponge iron is dumped in. Then, this second charge is melted down. This operation is carried out repeatedly until the EAF has reached its capacity of molten metal.

Normally, because of the large percentage of void regions in either scrap and sponge iron, a large number of charges is necessary during the melting stage to fill the EAF to its capacity. However, opening the EAF and charging it batchwise wastes a considerable amount of time; consequently, this repeated bucket charging of the furnace necessitates an increase in the time required for a steelmaking process, and thus carries with it implies a drop in productivity.

Accordingly, several methods of continuously charging sponge iron into an EAF have been previously proposed.

It has also been previously proposed to use a one hundred percent sponge-iron charge, rather than a combination of scrap and sponge iron, in an electric-arc steelmaking process. This proposal has come about due to an increase in the cost of scrap and a reduction in its availability, as well as the presence of unwanted materials contained in the scrap.

Another problem with the conventional bucket-charging system for electric arc furnaces is that care must be taken during the initial charge to bank the charge, as much as possible, against the walls of the furnace to protect the refractory material thereof from excessive heat produced in the arc. However, it would be undesirable to block the slagging door which is provided at one side of the furnace. Therefore, care must also be taken that a gap remain in the banked initial charge, at approximately the location of the slagging door.

OBJECTS AND SUMMARY OF THE INVENTION

It is accordingly an object of the present invention to provide an arrangement for charging an electric arc furnace with iron-containing particles, such as sponge iron, which avoids the problems of conventional systems, and permits rapid charging of the furnace to its full capacity.

It is more particularly an object of this invention to provide such an arrangement in which an initial charge of sponge iron is delivered to the furnace without necessitating operation of an overhead crane, and which will properly distribute the charge of sponge iron within the electric arc furnace to bank the charge against the refractory walls thereof, while leaving the slagging door free.

It is another object of this invention to provide a charging system for an electric furnace in which any necessary additional charging of sponge iron is carried out with the roof of the EAF in place.

It is yet another object of this invention to provide an improved charging system for an electric arc furnace which will improve the productivity thereof.

Other objects of the invention will be in part self-apparent and in part pointed out hereafter.

According to one of its broader aspects, the present invention provides apparatus for charging the electric arc furnace with a relatively free-flowing charge of iron-containing particles, such as sponge iron, with an improved distribution of the charge of particles within the furnace. This apparatus includes a bin or hopper containing a supply of the iron-containing particles and which is disposed at a location elevated with respect to the furnace. A first chute movable with respect to the furnace when the roof of the furnace is moved to open the same, has an upper end to receive the particles from the hopper and a lower end to feed the particles into the furnace as the initial charge. A distributor element, for example, a distributor cone, is disposed at the lower end of the first chute to distribute the particles exiting the first chute in a predetermined pattern within the furnace. A second chute affixed to the furnace roof has an upper end to receive the iron-containing particles and a lower end communicating through the roof with the interior of the furnace. A coupling arrangement for coupling the hopper with the second chute when the roof is in place to cover the top of the furnace permits continuous charging of the furnace, through the second chute, during a melting stage of the steelmaking operation.

The first chute can be used exclusively for the initial charge if a one-hundred percent sponge-iron charge is used. However, if a mixture of scrap and sponge iron is desired, the scrap can be charged into the furnace in a conventional manner using a scrap bucket carried by the overhead crane. Then, the first chute can be used to charge the EAF with sponge iron. Thus, when the furnace is charged with a mix of scrap and sponge iron, the time that it would normally take to move the crane to pick up a bucket of sponge iron, charge the sponge iron from the bucket, and then return the crane and the sponge-iron bucket, can be saved by use of the apparatus of this invention.

Furthermore, the continuous charge provided through the second chute during the melting stage provides a curtain of iron particles to absorb radiant excessive heat developed by the electric arc. This opaque curtain serves to shield the roof and walls of the furnace from this heat, and thus prolongs the life of the furnace. While this sponge iron is fed through the second chute only during a melting operation, it is noted that the current requirement following the melting stage, that is, during the refining stage, is only a fraction of that required during the melting stage. Consequently, this curtain is not necessary during the refining stage.

Other objects of the present invention will become more apparent from the following description and drawings. In this specification and accompanying drawings there is shown a preferred embodiment of the present invention; however, it is to be understood that this embodiment is not intended to be exhaustive or limiting of the invention. On the contrary, the illustrated embodiments are given for the purpose of illustration only in order that others skilled in the art may fully understand the invention and the purposes therof, and the manner of applying it for practical use so that they may modify and adapt it in various forms each as may be best suited for the conditions of a particular use.

BRIEF DESCRIPTION OF THE DRAWINGS

FIGS. 4 and 5 are a horizontal cross-section and elevational cross-section, respectively, of an electric arc furnace, and are used for explaining the present invention.

DETAILED DESCRIPTION OF A PREFERRED EMBODIMENT

Figure 1:
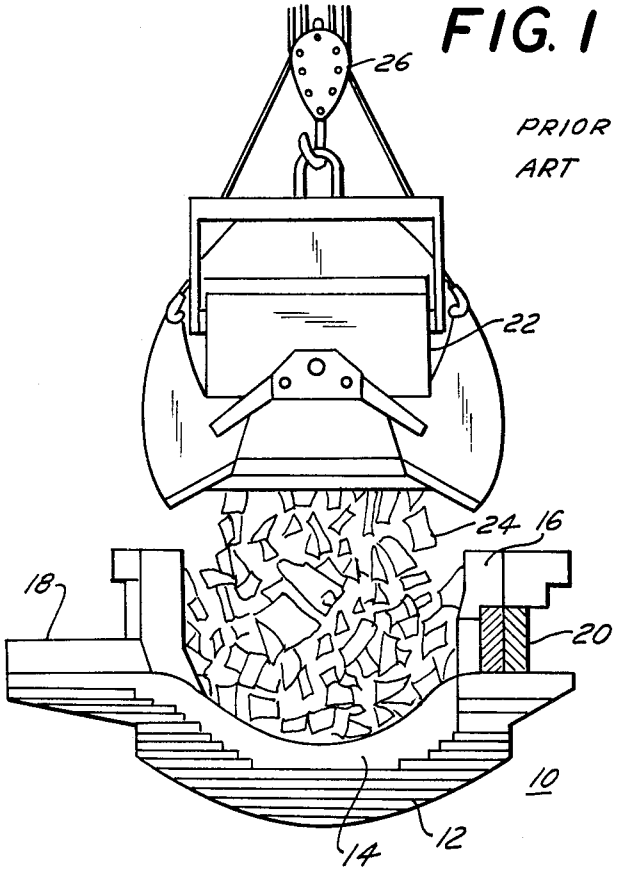
FIG. 1 PRIOR ART
FIG. 1 shows the bucket charging of scrap into an electric arc furnace, according to a conventional technique.

For purposes of explaining the background of this invention, and to underscore its advantages, a conventional system of bucket charging of scrap and sponge iron can be explained with reference FIGS. 1 and 2 of the accompanying drawings.

An electric arc furnace or EAF 10 as shown here is a cup-shaped vessel with a rounded bottom. In this furnace 10, a stadium-type sub-hearth 12 is formed of refractory material, for example, silicon brick, with a dished hearth 14, also of a refractory material, such as ganister. Above the hearth is a cylindrical wall 16 lined with refractory material. A trough 18 is provided at one side of the furnace 10 to permit pouring off of the molten metal in the furnace 10, and a slagging door 20 is provided opposite the trough 18. This door 20 is also lined with a refractory material.

In the conventional charging technique, a scrap bucket 22 containing scrap steel 24 is brought by a crane 26 to a point over the open top of the EAF 10. Then, gates on the scrap bucket 22 are opened, and the scrap steel 24 is dropped onto the hearth 14 of the EAF 10. In this conventional loading technique care must be taken to load small scrap pieces to fall first onto the hearth 14, because the larger, heavier pieces, if falling directly on the refractory material, can cause chipping or other damage.

Figure 2:
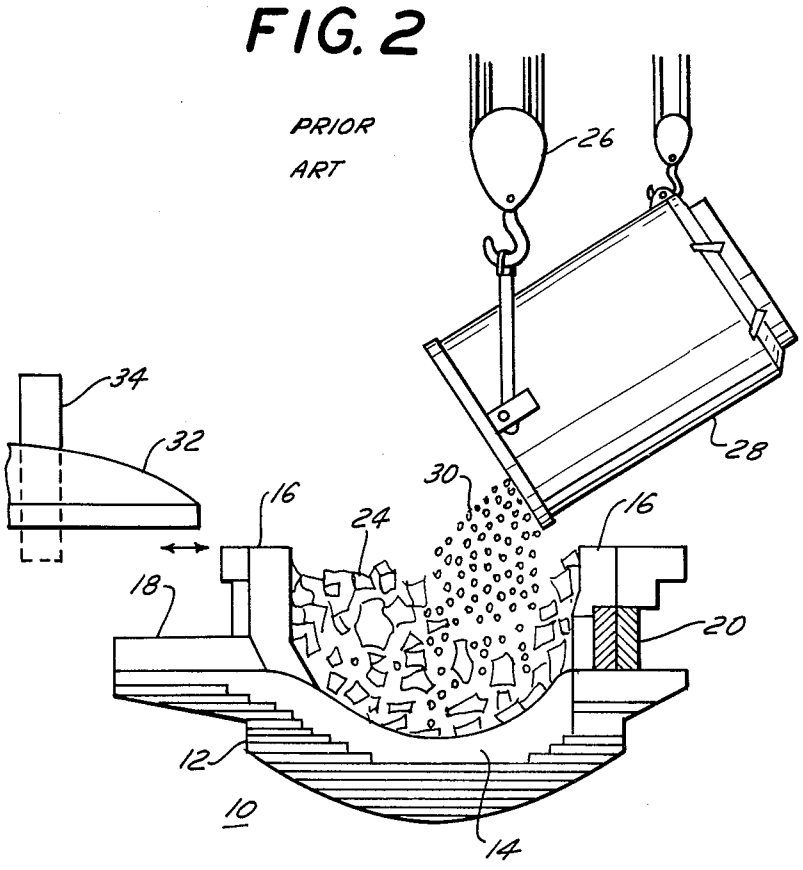
FIG. 2 PRIOR ART
FIG. 2 shows a bucket charging of sponge iron into an electric arc furnace, according to the conventional technique.

After the EAF 10 has been charged with scrap 24, the crane 26 brings a sponge iron bucket 28, as shown in FIG. 2, and particles of sponge iron 30 are carefully poured from the bucket 28 into the EAF 10. This sponge iron 30 is preferably banked against the cylindrical wall 16 to shield the same from radiant heat generated by the electric arc during the melting stage. The bucket 28 must be carefully manipulated while charging the EAF 10 with the sponge iron 30 so as not to be banked against the slagging door 20. This is necessary to keep the door 20 clean.

After the initial charging of the sponge iron 30, a roof 32 for the EAF 10 is swung into place over the top of the furnace, and electrodes 34 are lowered. Then, current is applied to the electrodes 34 to cause arcing, and the charge material 24 and 30 is melted.

After the scrap 24 and sponge iron 30 are melted, the electrodes 34 are raised, and the roof 32 is swung aside. Then, the charging steps illustrated in FIGS. 1 and 2 are repeated, the roof 32 is swung back over the open top of the furnace 10, the electrodes 34 are again lowered, the electric are is started again, and the fresh charge of scrap 24 and sponge iron 30 is melted. The above steps are repeated until the EAF 10 is filled to its hearth line with molten metal.

It is apparent that a considerable amount of time and effort is involved in swinging the roof 32 back and forth between the various charges of scrap 24 and sponge iron 30 into the furnace 10. A substantial amount of time is also required for the crane to pick up each of the buckets 22 and 28, carry them over the open furnace 10, and dump the charge of scrap 24 or sponge iron 30 into the furnace 10. It is further apparent that any time which could be saved in these steps would serve to shorten the time required for the melting stage, and hence would increase the productivity of the EAF 10. Moreover, each time the electrodes 34 are lifted and the roof 32 is swung away from the top of the furnace 10, a considerable amount of heat escapes from the furnace 10. Thus, elimination of the necessity to open the furnace during the melting stage would reduce the amount of energy required for melting the charge of scrap 24 and/or sponge iron 30, and would thus reduce the total amount of electricity required to be supplied to the electrodes 34.

It is also well known that noxious, and ofttimes toxic gases are produced during the melting stage. If the necessity to open the roof 32 of the furnace 10 between charges can be eliminated, escape of such gases into the atmosphere can be abated, thereby presenting steel workers with a safer environment.

Figure 3:
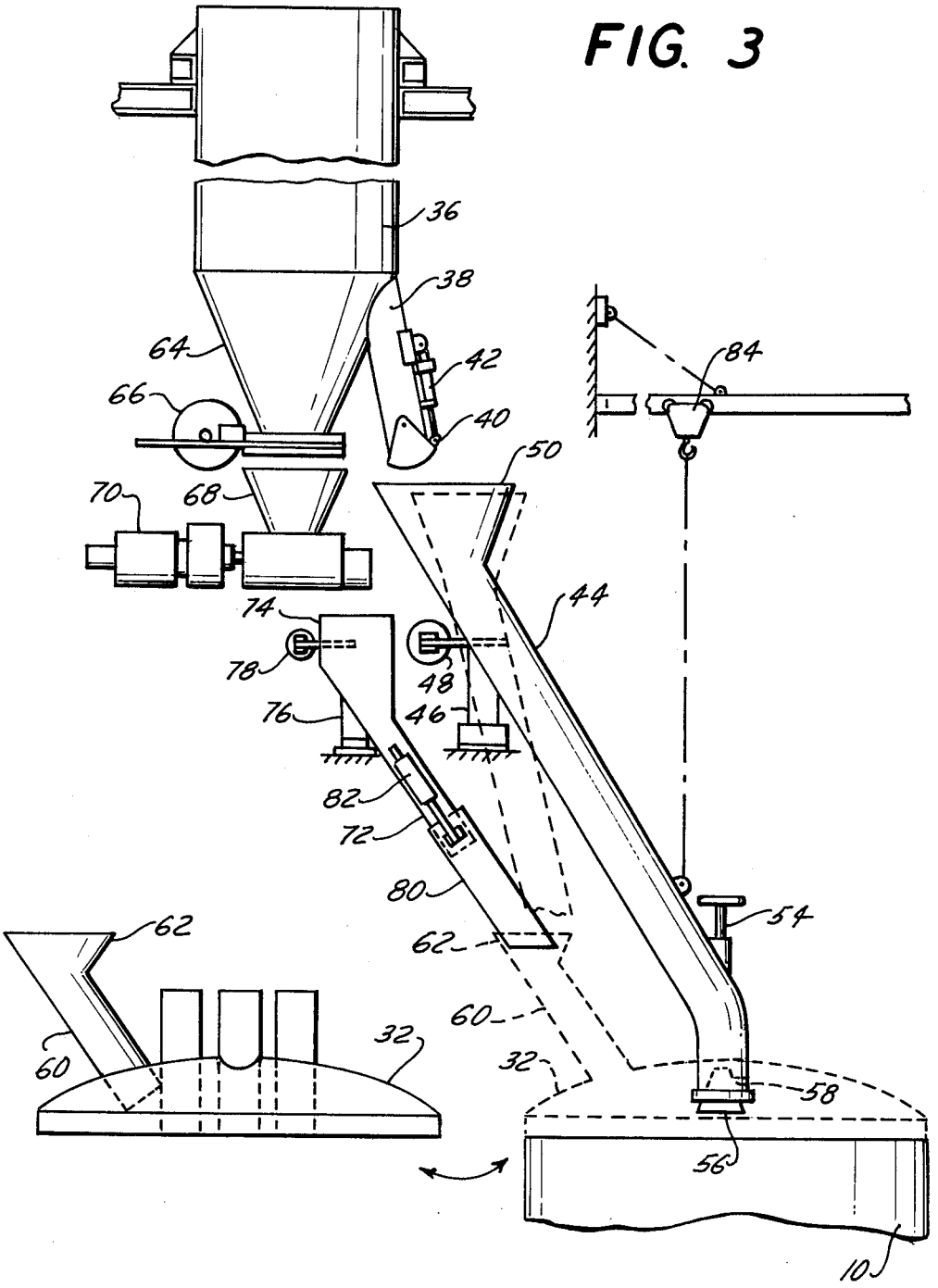
FIG. 3 shows an arrangement according to this invention for initial chute-charging and subsequent continuous chute-charging of an electric arc furnace.

FIG. 3 illustrates an improved arrangement for charging the furnace 10 with sponge iron, or other iron-containing particles. This arrangement avoids the need for the crane-carried buckets 22 and 28 if a charge of sponge iron only is used, and if a combination charge of scrap 24 and sponge iron 30 is used, only the scrap bucket 22 needs to be used.

Here, the roof 32 with its associated electrodes 34 has been moved laterally to one side to open the top of the furnace 10. A bin or hopper 36 containing the sponge iron 30 is disposed at a position elevated and to one side of the EAF 10. A charging pipe 38 descends a short distance from the hopper 36 and has a rotary gate 40 at its lower end which is opened and closed by a double-piston actuator 42. A large, rapid-loading chute 44, supported on a rotary mount 46, is shown to be in position for feeding a rapid initial charge of the sponge iron 30 into the interior of the furnace 10. This chute 44 can be rotated by an actuator 48 to the position shown in the dotted lines in FIG. 3.

In the illustrated solid-line position, an upper funnel 50 of the chute 44 is disposed adjacent the lower end of the pipe 38, and a lower opening 52 is disposed over the open top of the furnace 10. Here, a shut-off 54 is provided near the lower opening 52, and a distributor cone 56, as better shown in FIGS. 4 and 5, is situated in the lower opening 52. A blockage 58 mounts the distributor cone 56 on the inside of the lower opening 52 of the chute 44. This blocage 58 is disposed on the side of the chute 44 corresponding to the location of the slagging door 20.

To load the furnace 10 with a rapid initial charge, the chute 44 is rotated into the position illustrated, with the roof 32 swung to the side. Then, the actuator 42 opens the gate 40, and the sponge iron 30 flows down the chute 44 to the lower opening 52 thereof, where the distributor cone 56 distributes the sponge iron 30 in a C-shaped pattern (FIG. 4), banked against the sides of the EAF 10 to protect the refractory lining thereof.

The blockage 58 casts a charge shadow, that is, creates a gap area in a charge 30, in the vicinity of the slagging door 20 (FIG. 5).

When a sufficient charge of the sponge iron 30 has been supplied to the EAF 10, the gate 40 is closed, and the chute 44 is swung aside to the dotted-line position.

A second, continuous-feed chute 60 is affixed to the furnace roof 32 and has an upper funnel 62 to receive the particles of sponge iron 30. This chute 60 extends through the roof 32 of the EAF to communicate with the inside of the EAF 10 when the roof 32 is in place, that is, in its dotted-line position shown in FIG. 3.

An arrangement described now provides a supply of the sponge iron 30 from the hopper 36 to the chute 60 for a continuous charge of the sponge iron 30 during the melting stage.

Beneath the hopper 36 is a hopper cone 64 provided with a guillotine gate 66 which selectively opens and closes the cone 64. A rotary feeder 22, which can be, for example, a rotary valve, is driven by a variable speed motor 70.

A connection chute 72 has an upper funnel 74 to receive the continuous charge of sponge iron from the feeder 68, and is supported on a rotary mount 76. An actuator 78 rotates this chute 72 about the mount 76.

An extendable/retractable lower portion 80 of the connection chute 72, supported by a double-piston actuator 82, can be selectively extended or retracted for engagement and disengagement with the funnel 62 of the second chute 60.

The coupling chute 72 can be arranged to pivot on its mount 76 and swing with the swinging movement of the roof 32. Alternatively, the actuator 82 can withdraw the extendable/retractable portion 80 from the funnel 62 of the second chute 60 to permit swinging of the roof 32 without interference from the connection chute 72.

It should be apparent that the continuous charging carried out by the second chute 60 and the connecting chute 72 avoids the necessity of opening the roof 32 of the EAF 10 for the recharging of the latter. Consequently, the length of time required for the melting stage is shortened, thereby increasing the productivity of the EAF 10.

In addition, the continuous charging of particles of the sponge iron 30 through the second chute 60 serves to create an opaque curtain to shield the refractory materials on the walls 16 and roof 32 of the EAF 10 from excessive radiant heat. This continuous charge of sponge iron 30 also serves to cool hot gases which are generated during the melting stage.

Also shown in the drawing 14 is a crane 84 which can be used to help suspend the large primary charging chute 44 so that its lower opening 52 is disposed at the proper location for initially charging the furnace 10 with the sponge iron 30.

While there has been described what is at present considered to be the preferred embodiment of this invention, it will be obvious to those skilled in the art that various changes and modifications may be made therein without departing from the scope and spirit of this invention, and it is, therefore, aimed that the appended claims cover all such changes and modifications as may fall within the true spirit and scope of this invention.

What is claimed is:

1. Apparatus for charging an electric arc furnace with a relatively free-flowing charge of iron-containing particles with improved distribution of the charge of particles within the furnace, the electric arc furnace having a roof laterally movable to selectively open and cover the top of the furnace, comprising hopper means containing a supply of said iron-containing particles disposed at a location elevated with respect to said furnace;

a first chute movable with respect to said furnace when said roof is moved to open the furnace and having an upper end to receive said particles from said hopper and a lower end to feed said particles into said furnace;

distributor means disposed at the lower end of said first chute to distribute said particles exiting said first chute in a predetermined pattern within said furnace;

a second chute affixed to the furnace roof having an upper end to receive said iron-containing particles and a lower end communicating through said roof with the interior of said furnace; and coupling means for coupling said hopper means with said second chute, when said roof is in place to cover the top of said furnace, to permit continuous charging of said furnace during operation.

2. Apparatus for charging an electric arc furnace as recited in claim 1, wherein said electric arc furnace has a slagging door in a vertical wall thereof, and said distributor means includes a rounded member disposed in the lower end of said first chute with an attaching portion connected to said chute at the side corresponding to the location of the slagging door.

3. Apparatus for charging an electric arc furnace as recited in claim 2, wherein said rounded member is generally conical.

4. Apparatus for charging an electric arc furnace as recited in claim 1, wherein said electric arc furnace has a generally cylindrical wall with a slagging door in one side thereof, and said distributor means includes means to direct the iron-containing particles in a generally C-shaped pattern about the wall of the furnace but with a gap at the location of said slagging door.

5. Apparatus for charging an electric arc furnace as recited in claim 1, wherein said coupling means includes a gate at a lower portion of said hopper means, a rotary feeder disposed beneath said gate, and a variable speed motor driving said rotary feeder to deliver a controlled continuous flow of said iron-containing particles.

6. Apparatus for charging an electric arc furnace as recited in claim 1 or claim 5, wherein said coupling means includes an additional chute extending diagonally from said hopper means to said second chute, and rotatable on a vertical axis to move with said second chute and said furnace roof.

7. Apparatus for charging an electric arc furnace as recited in claim 6, wherein said additional chute includes a lower extensible portion and means to extend and retract said lower extensible portion.

8. Apparatus for charging an electric arc furnace with a relatively free-flowing charge of iron-particles with improved distribution of the charge within the furnace, the electric arc furnace having roof laterally movable to open and to cover the top of the furnace, selectively, wherein said electric arc furnace has a slagging door in a vertical wall thereof, comprising hopper means containing a supply of said iron-containing particles disposed at a location elevated with respect to said furnace;

a charging chute movable with respect to said furnace when said roof is moved to open the furnace and having an upper end to receive said particles from said hopper and a lower end to feed said particles into said furnace; and distributor means disposed at the lower end of said charging chute to distribute said particles in a predetermined non-uniform pattern within said furnace, wherein said distributor means includes a rounded member disposed within the lower end of said charging chute with an attaching portion connected to said chute at the side corresponding to the location of said slagging door.

9. Apparatus for charging an electric arc furnace as recited in claim 8, wherein said rounded member is generally conical.

10. Apparatus for charging an electric arc furnace as recited in claim 9, wherein the generally conical rounded member has an apex directed upward.

11. Apparatus for charging an electric arc furnace as recited in claim 8, wherein said electric arc furnace has a generally cylindrical wall with a slagging door in one side thereof, and said distributor means includes means to direct the iron-containing particles in a generally C-shaped pattern about the wall of the furnace but with a gap at the location of said slagging door.

12. Apparatus for charging an electric arc furnace with a relatively free-flowing charge of iron-containing particles with improved distribution of charge within the furnace, the electric arc furnace having a roof laterally movable to open and to cover the top of the furnace, selectively, comprising hopper means containing a supply of said iron-containing particles disposed at a location elevated with respect to said furnace;

a first chute movable with respect to said furnace when said roof is moved to open the furnace and having an upper end to receive said particles from said hopper and a lower end to feed said particles into said furnace;

a second chute affixed to the furnace roof having an upper end to receive said iron-containing particles and a lower end communicating through said roof with the interior of said furnace; and coupling means for coupling said hopper means with said second chute, when said roof is in place to cover the top of said furnace, to permit continuous charging of said furnace during operation.

13. Apparatus for charging an electric arc furnace as recited in claim 12, wherein said coupling means includes a gate at a lower portion of said hopper means, a rotary feeder disposed beneath said gate, and a variable speed motor driving said rotary feeder to deliver a controlled continuous flow of said iron-containing particles.

14. Apparatus for charging an electric arc furnace as recited in claim 12 or claim 13, wherein said coupling means includes an additional chute extending diagonally from said hopper means to said second chute, and rotatable on a vertical axis to move with said second chute and said furnace roof.

15. Apparatus for charging in electric arc furnace as recited in claim 15, wherein said additional chute includes a lower extensible portion and means to extend and retract said lower extensible portion.

16. Method for charging an electric arc furnace with a relatively free-flowing charge of iron-containing particles, the electric arc furnace having a roof laterally movable to open and cover the top of the furnace, comprising the steps of moving said roof laterally to open said furnace;

position a charging chute over said open furnace;

supplying a predetermined quantity of the iron-containing particles through said charging chute to said furnace;

moving said roof laterally to cover said furnace;

starting the melting of said iron-containing particles in said furnace; and continuously supplying and simultaneously melting iron-containing particles through the roof of said surface until said furnace has reached its capacity of molten metal.

17. Method for charging an electric arc furnace as recited in claim 16, wherein the step of supplying includes distributing said iron-containing particles in a predetermined pattern within said furnace.

18. Method for charging an electric arc furnace with a relatively free-flowing charge of iron-containing particles, the electric arc furnace having a roof laterally movable to open and cover the top of the furnace, comprising the steps of moving said roof laterally to open said furnace;

positioning a first charging chute over said open furnace;

supplying a predetermined quantity of the iron-containing particles through said charging chute to said furnace;

moving said roof laterally to cover and close said furnace;

starting the melting of said iron-containing particles in said furnace;

positioning a second charging chute such that a lower thereof communicates through the closed roof with the interior of said furnace; and continuously supplying at a regulated rate, and simultaneously melting, iron-containing particles through the second charging chute into said furnace until said furnace has reached its capacity of molten metal.

* * * * *